US008939237B2

(12) United States Patent
Runquist et al.

(10) Patent No.: US 8,939,237 B2
(45) Date of Patent: Jan. 27, 2015

(54) UNDERGROUND DRILLING APPARATUS

(75) Inventors: Randy R. Runquist, Knoxville, IA (US); Keith A. Hoelting, Dallas, IA (US)

(73) Assignee: Vermeer Manufacturing Company, Pella, IA (US)

( * ) Notice: Subject to any disclaimer, the term of this patent is extended or adjusted under 35 U.S.C. 154(b) by 729 days.

(21) Appl. No.: 13/247,327

(22) Filed: Sep. 28, 2011

(65) Prior Publication Data

US 2012/0118640 A1 May 17, 2012

Related U.S. Application Data

(60) Provisional application No. 61/413,058, filed on Nov. 12, 2010.

(51) Int. Cl.

| | |
|---|---|
| ***E21B 10/26*** | (2006.01) |
| ***E21B 7/06*** | (2006.01) |
| ***E21B 47/01*** | (2012.01) |
| ***E21B 7/04*** | (2006.01) |

(52) U.S. Cl.

CPC ..... *E21B 47/01* (2013.01); *E21B 47/011* (2013.01); *E21B 7/046* (2013.01); *E21B 7/064* (2013.01)

USPC ..... 175/398; 175/400

(58) Field of Classification Search

CPC ..... E21B 7/064; E21B 7/046; E21B 47/011; E21B 17/046

USPC ..... 175/398–400, 61, 74

See application file for complete search history.

(56) References Cited

U.S. PATENT DOCUMENTS

| | | | |
|---|---|---|---|
| 3,685,601 | A | 8/1972 | Hollingshead |
| 5,020,608 | A | 6/1991 | Odén et al. |
| 5,148,880 | A | 9/1992 | Lee et al. |
| 5,253,721 | A | 10/1993 | Lee |
| 5,469,926 | A | 11/1995 | Lessard |
| 5,645,132 | A | 7/1997 | Åsberg |
| 5,899,283 | A | 5/1999 | Cox |
| 5,931,240 | A | 8/1999 | Cox |
| 5,934,391 | A | 8/1999 | Cox |
| 5,950,743 | A | 9/1999 | Cox |
| 6,148,935 | A | 11/2000 | Wentworth et al. |
| 6,209,660 | B1 | 4/2001 | Cox |
| 6,260,634 | B1 | 7/2001 | Wentworth et al. |
| 6,263,983 | B1 | 7/2001 | Wentworth et al. |
| 6,390,087 | B1 | 5/2002 | Wentworth et al. |
| 6,422,782 | B1 | 7/2002 | Wentworth |
| 6,450,269 | B1 | 9/2002 | Wentworth et al. |
| 6,470,979 | B1 | 10/2002 | Wentworth et al. |
| 6,484,823 | B2 | 11/2002 | Olsson et al. |
| 6,581,680 | B1 | 6/2003 | Wentworth |

(Continued)

OTHER PUBLICATIONS

International Search Report and Written Opinion mailed Jun. 22, 2012.

*Primary Examiner* — Giovanna Wright

(74) *Attorney, Agent, or Firm* — Merchant & Gould P.C.

(57) ABSTRACT

A drilling apparatus is adapted for connection to a drill string such that the drill string rotates the drilling apparatus in a rotational cutting motion. The drilling apparatus includes a sonde housing having a distal end and a proximal end. The sonde housing includes a top platform positioned adjacent the distal end of the sonde housing and further includes a tongue positioned on the top platform. The drilling apparatus further includes a rotary cutting tool mounted to the distal end of the sonde housing.

25 Claims, 18 Drawing Sheets

(56) References Cited

U.S. PATENT DOCUMENTS 6,588,515 B2 7/2003 Wentworth et al.
6,810,971 B1 11/2004 Sved
6,810,972 B2 11/2004 Sved
6,810,973 B2 11/2004 Sved
6,814,168 B2 11/2004 Sved
6,827,159 B2 12/2004 Sved
7,172,035 B2 2/2007 Michael et al.

UNDERGROUND DRILLING APPARATUS

CROSS REFERENCE TO RELATED APPLICATIONS

The present application claims priority to U.S. Provisional Patent Application Ser. No. 61/413,058 entitled "Underground Drilling Apparatus" and filed on Nov. 12, 2010, the disclosure of which is hereby incorporated by reference in its entirety.

TECHNICAL FIELD

The present invention relates generally to underground drilling equipment. More particularly, the present disclosure relates to drill heads and sonde housings adapted to be mounted at the end of a drill string.

BACKGROUND

Underground drilling systems often use a rotary drilling tool to form a bore in the ground. The rotary drilling tool is typically mounted at a distal end of a drill string including a plurality of drill rods (e.g., drill pipes) strung together end-to-end. The drill string transfers thrust and torque from a proximal drive mechanism (e.g., an above-ground drive mechanism) to the rotary drilling tool. In this way, the drill string is used to rotate the rotary drilling tool about a longitudinal axis of the drill string and is concurrently used apply thrust in a distal direction to the rotary drilling tool. Drill rods are progressively added to the drill string to increase the length of the bore. For certain applications, the rotary drilling tool includes structure (e.g., a slanted/angled face) that allows the rotary drilling tool to be steered to control the direction in which the bore is drilled. A sonde can be provided adjacent the rotary drilling tool for use in monitoring operational parameters of the rotary drilling tool such as pitch and rotational orientation (i.e., roll or clock position). The sonde can also work with other equipment to allow a geographic position of the drilling tool to be determined. The sonde typically interfaces with a control system that used to control the direction in which the rotary drilling tool travels. An example drilling system including a sonde is disclosed in U.S. Pat. No. 7,172,035, which is hereby incorporated by reference in its entirety.

SUMMARY

Certain aspects of the present disclosure relate to techniques and arrangements for coupling rotary cutting tools to drive members such as sonde housings.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
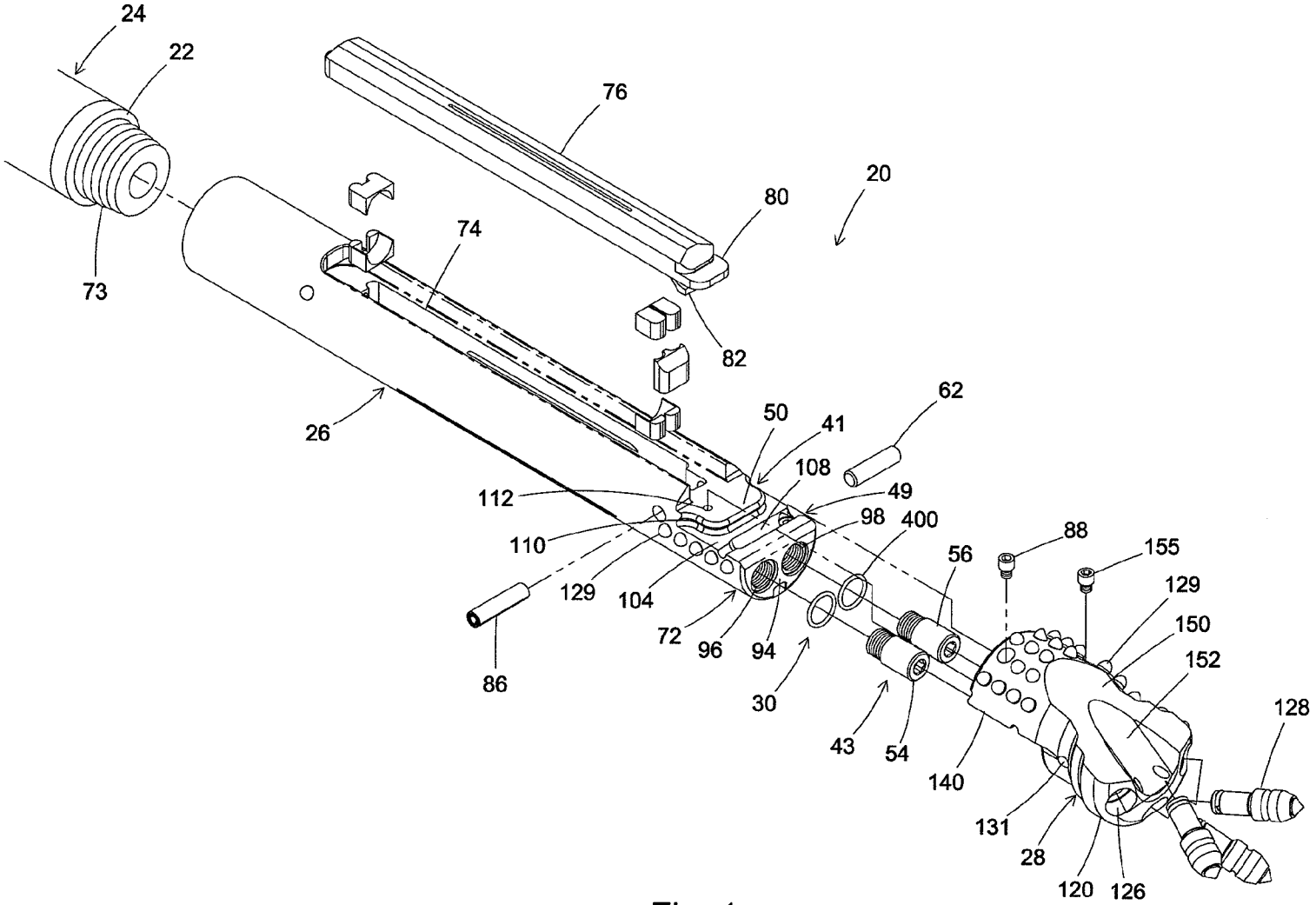
FIG. 1 is an exploded, perspective view of a sonde housing and rotary cutting tool in accordance with the principles of the present disclosure.
Figure 2:
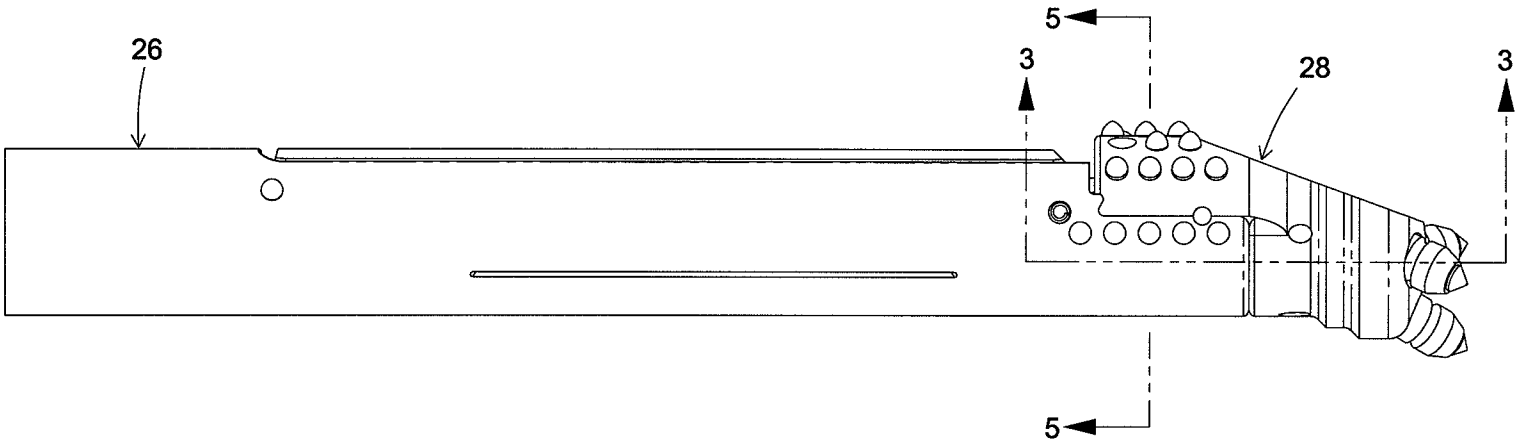
FIG. 2 is a side view of the sonde housing and rotary cutting tool of FIG. 1 shown coupled to one another.

FIG. 1 illustrates a drilling apparatus 20 in accordance with the principles of the present disclosure. The drilling apparatus 20 is adapted for connection to a distal end 22 of a drill string 24 such that the drill string 24 can be used to rotate the drilling apparatus 20 in a rotational cutting motion about a central axis of rotation of the drill string 24. Referring to FIG. 1, the drilling apparatus 20 includes a sonde housing 26 and a rotary cutting tool 28 (i.e., a rotary drilling tool) that mounts to the sonde housing 26. A coupling interface 30 is provided between the sonde housing 26 and the rotary cutting tool 28. The coupling interface 30 is adapted to mechanically secure the rotary cutting tool 28 to the sonde housing 26 such that torque can be transferred between the sonde housing 26 and the rotary cutting tool 28. Additionally, the coupling interface 30 is configured to insure that the rotary cutting tool 28 remains attached to the sonde housing 26 during drilling operations, and also allows thrust and pull back loads to be transferred from the sonde housing 26 to the rotary cutting tool 28. The coupling interface 30 is also configured to allow the rotary cutting tool 28 to be quickly coupled and uncoupled from the sonde housing 26.

Figure 7:
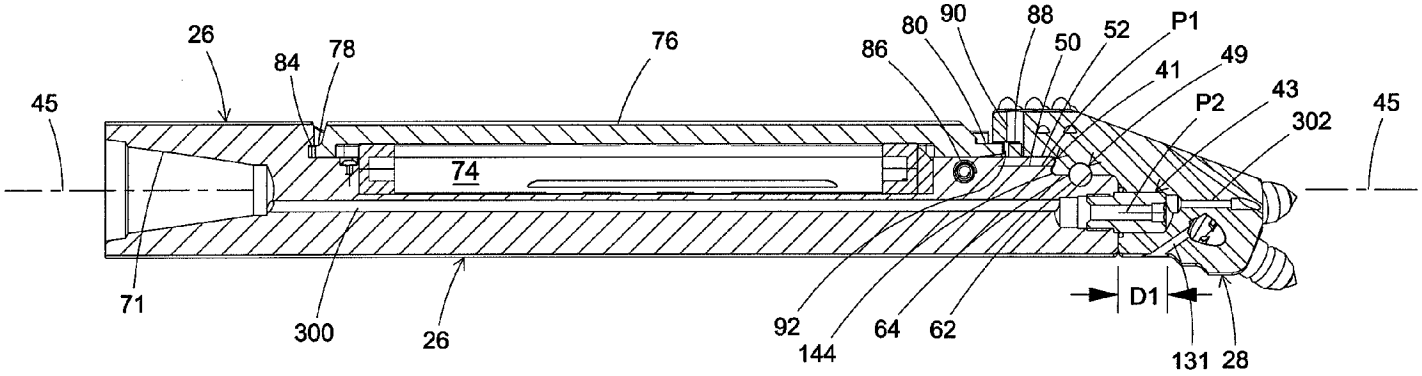
FIG. 7 is a cross-sectional view taken along section line 7-7 of FIG. 6.

As shown at FIG. 7, the coupling interface 30 includes a first torque transfer structure 41 aligned generally along a first slide plane P1 and a second torque transfer structure 43 aligned along a second slide plane P2 that is parallel to and offset from the first slide plane P1. The slide planes P1 and P2 are positioned on opposite sides of a central longitudinal axis 45 of the sonde housing 26 and are parallel to the central longitudinal axis 45. The coupling interface 30 further includes an axial load transfer structure 50 for preventing the rotary drilling tool 28 from being unintentionally slid off of the sonde housing 26 during pull-back operations. The axial load connection structure 50 can further be configured to carry at least some axial load transferred between the rotary cutting tool 28 and the sonde housing 28 during thrust drilling operations.

The first and second torque transfer structures 41, 43 are configured to transfer torque between the sonde housing 26 and the rotary cutting tool 28 during drilling operations. The axial load connection structure 50 is configured to allow axial load to be transferred between the rotary cutting tool 28 and the sonde housing 26. For example, the axial load connection structure 49 transfers axial load between the sonde housing 26 and the rotary cutting tool 28 during pull back operations such that the cutting tool 28 is prevented from disengaging from the sonde housing 26. In certain embodiments, the axial load transfer structure 49 can also be configured to transfer axial load between the rotary cutting tool 28 and the sonde housing 26 during thrust operations.

As depicted is FIGS. 1, 3, 4 and 7, the first torque transfer structure 41 includes a tongue-and-groove arrangement including a tongue 50 and groove 52 (see FIG. 7) that slide axial together when the sonde housing 26 and the rotary cutting tool 28 are coupled together. The second torque transfer structure 43 includes a pin-and-socket arrangement having first and second pins 54, 56 that slide axial within corresponding first and second sockets 58, 60 (see FIGS. 3 and 4) when the sonde housing 26 and the rotary cutting tool 28 are coupled together. The first slide plane P1 is the plane centered on the first torque transfer structure 41 along which the tongue 50 and the groove 52 slide relative to one another as the tongue 50 and groove 52 are mated together. The second slide plane P2 is the plane centered on the second torque transfer structure 43 along which the first and second pins 54, 56 slide relative to the first and second sockets 58, 60 as the pins 54, 56 are mated within the sockets 58, 60.

Referring still to FIGS. 1 and 7, the axial load transfer structure 49 includes a cross-member 62 (e.g., a cross pin) that fits within a cross-opening 64 cooperatively defined by the rotary cutting tool 28 and the sonde housing 26. The cross-opening 64 is elongated along a length that extends generally in a direction transverse relative to the central longitudinal axis 45 of the sonde housing 26.

The coupling interface 30 is configured to allow the rotary cutting tool 28 to be quickly engaged and disengaged from the sonde housing 26. In this regard, the coupling interface 30 preferably has an axial slide dimension D1 (see FIG. 7) that is relatively short. The axial slide dimension D1 is the distance the rotary cutting tool 28 and the sonde housing 26 slide relative to one another along the first and second slide planes P1, P2 during the engagement process and during the disengagement process. Because the axial slide dimension D1 is relatively short, the rotary cutting tool 28 and the sonde housing 26 can be quickly and easily slid together and slid apart. In the depicted embodiment, the axial slide dimension D1 is less than 2-inches.

The configuration of the axial load transfer structure 49 also is conducive to providing rapid connections and disconnections between the sonde housing 26 and the rotary cutting tool 28. A connection is made by driving the cross-member 62 into the cross-opening 64 and then capturing the cross-member 62 within the cross-opening 64 with a fastener. A disconnection is accomplished by removing the fastener capturing the cross-member 62 within the cross-opening 64, and then driving the cross-member 62 out of the cross-opening 64.

It will be appreciated that the sonde housing 26 is configured for holding a sonde used to monitor operational parameters of the rotary drilling tool such as pitch and rotational orientation (i.e., roll position or clock position). The sonde can be secured in a compartment of the sonde housing at a fixed position relative to the tongue 50 and the pins 54, 56. The sonde housing can be configured to allow side loading of the sonde, end loading of the sonde or other loading configurations. Further details about an example sonde are disclosed at U.S. Pat. No. 7,172,035, which was previously incorporated by reference herein.

Figure 8:
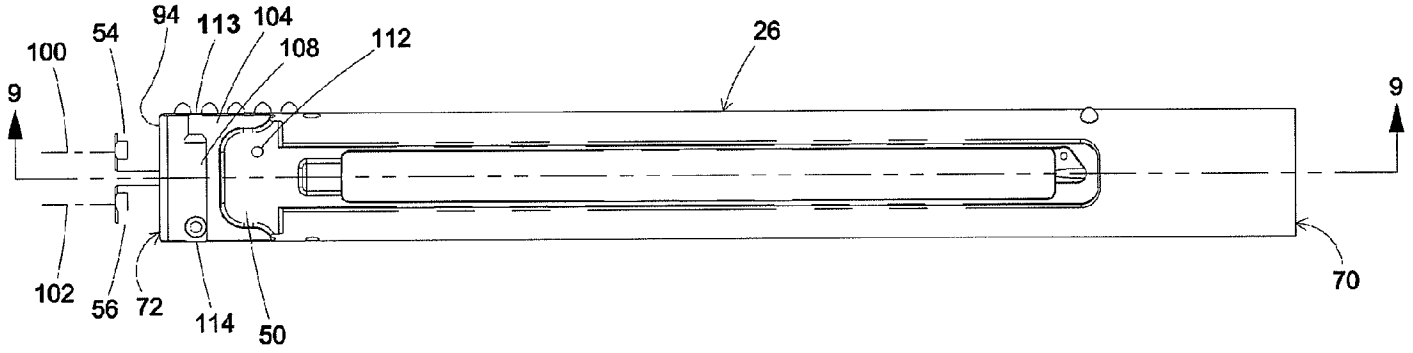
FIG. 8 is a top view of the sonde housing of FIG. 1.
Figure 9:
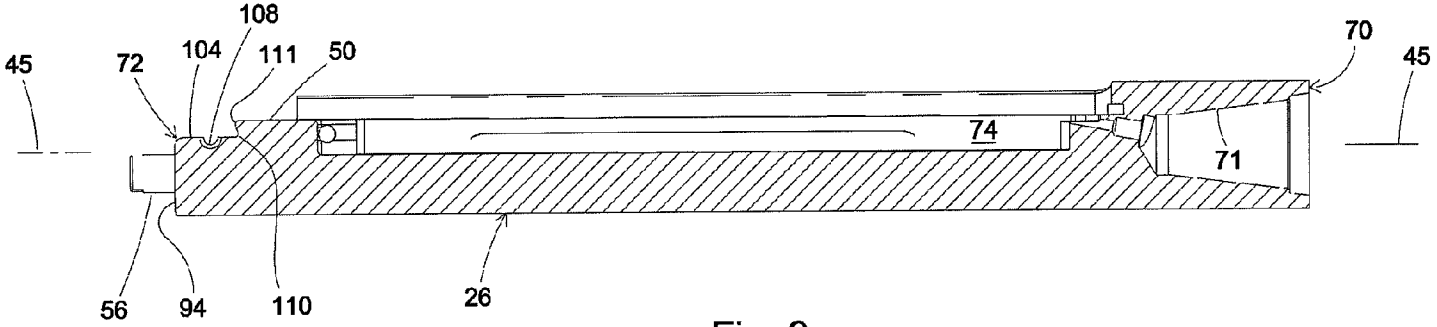
FIG. 9 is a cross-sectional view taken along section line 9-9 of FIG. 8.
Figure 10:
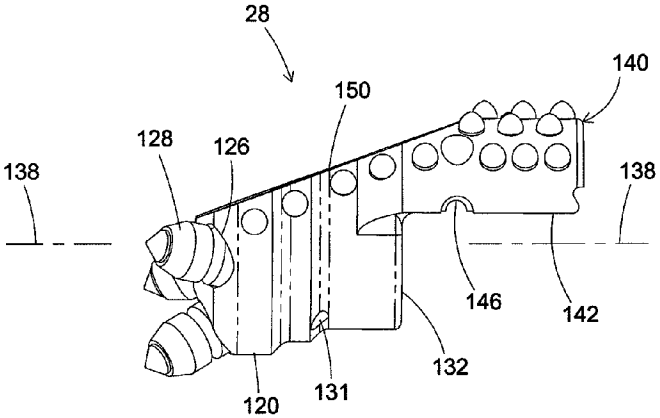
FIG. 10 is a side view of the rotary cutting tool of FIG. 1.

Referring to FIGS. 7-9, the sonde housing 26 is elongated along the central longitudinal axis 45. A length of the sonde housing 26 extends along the central longitudinal axis 45 from a proximal end 70 of the sonde housing 26 to a distal end 72 of the sonde housing 26. The sonde housing 26 defines an elongate sonde compartment 74 having a length that extends along the central longitudinal axis 45 of the sonde housing 26. The sonde compartment 74 has an open top side that can be covered by a removable cover member 76. The removable cover member 76 includes a proximal tab 78, a distal tab 80 and a bottom catch 82. When the removable cover 76 is mounted over the sonde compartment 74, the proximal tab 78 fits within a notch 84 of the sonde housing 26 and the distal tab 80 is captured underneath a rear portion of the rotary cutting tool 28. A cross-member 86 (e.g., a roll pin) engages the bottom catch 82 so as to prevent the removable cover 76 from sliding in a distal direction when the cross-member 86 is in place. In this way, the cross-member 86 and the bottom catch 82 prevent the proximal tab 78 from disengaging from the notch 84. A redundant fastener 88 (e.g., a cap screw) is secured (e.g., threaded into) the sonde housing 26 at a location immediately distal to the distal tab 80 to also prevent the removable cover 76 from sliding in a distal direction. To remove the removable cover 76 from the sonde housing 26, the cross-member 86 is removed by punching the cross-member 86 transversely from the sonde housing 26 and the redundant fastener 88 is removed by unthreading the redundant fastener 88 from the sonde housing 26 and removing the fastener 88 through an access opening 90 defined through the rotary cutting tool 28. With the cross-member 86 and the redundant fastener 88 removed, the removable cover member 76 can be slid in a distal direction to disengage the proximal tab 78 from the notch 84. Thereafter, the removable cover 76 can be pivoted upwardly from the proximal end and the distal tab 80 can be slid out from beneath the rear portion of the rotary cutting tool 28.

Figure 6:
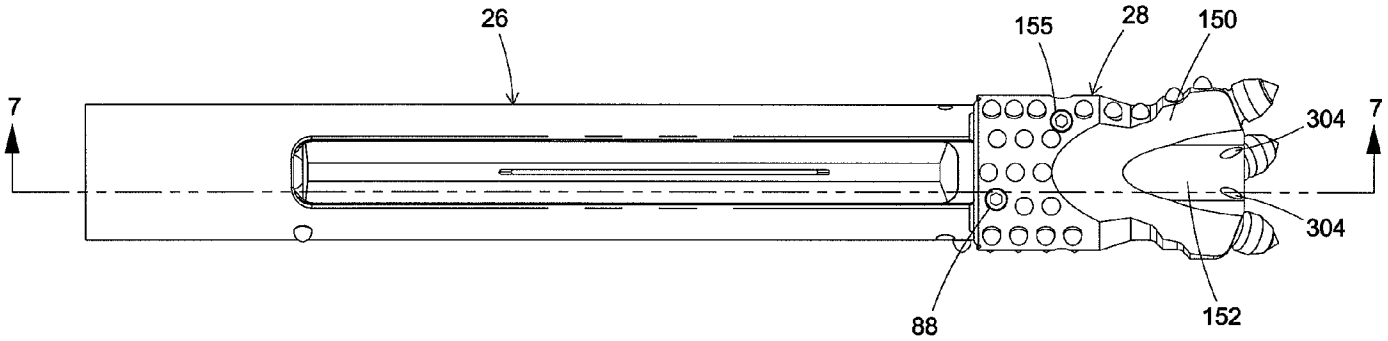
FIG. 6 is a top view of the sonde housing and the rotary cutting tool of FIG. 1 with the rotary cutting tool coupled to the sonde housing.

Referring still to FIG. 6, the redundant fastener 88 is positioned within a recess 92 at the rear portion of the rotary cutting tool 28. The recess 92 allows the rotary cutting tool 28 to be removed from the sonde housing 26 without interference from the redundant fastener 88. In this way, the rotary cutting tool 28 can be removed from the sonde housing 26 without removing the redundant fastener 88 and without removing the removable cover 76 from the sonde housing 26.

The proximal end 70 of the sonde housing 26 is adapted for connection to the distal end 22 of the drill string 24. For example, as shown at FIGS. 7 and 9, the proximal end 70 of the sonde housing 26 comprises a female end having a socket 71 with internal threads and the distal end 22 of the drill string 24 comprises a male end having a shank 73 with external threads. In this way, the distal end 22 of the drill string 24 can be readily threaded into the proximal end 70 of the sonde housing 26.

Referring to FIGS. 1, 8 and 9, the distal end 72 of the sonde housing 26 is adapted to couple to the rotary cutting tool 28. The distal end 72 includes a distal end face 94 facing in a distal direction. The distal end 72 of the sonde housing 26 defines first and second end receptacles 96, 98 that extend from the distal end face 94 proximally into the sonde housing 26. The first and second end receptacles 96, 98 have central axes 100, 102 that extend along the central longitudinal axis 45 of the sonde housing 26. The distal end 72 of the sonde housing 26 also includes a top platform 104 that extends along the central longitudinal axis 45 in a proximal direction from the distal end face 94. The top platform 104 has a top face that faces in an upward direction. A first cross-slot 108 is defined by the top platform 104. The first cross-slot 108 has a length that is transverse relative to the central longitudinal axis 45 of the sonde housing 26. The first cross-slot 108 has an open sided configuration with an open top side position at the top face of the top platform 104. The first cross-slot 108 defines a reduced diameter portion 112 positioned adjacent to one side of the sonde housing 26 and a fastener receptacle 114 positioned adjacent the opposite side of the sonde housing 26. The distal end 72 of the sonde housing also includes the tongue 50 of the first torque transfer structure 41. The tongue 50 is provided on the top platform 104 adjacent to the distal end of the sonde compartment 74. The tongue 50 includes an undercut region 110 that extends about a perimeter of the tongue 50. The undercut region 110 is positioned beneath an overhang region 111 of the tongue 50. A threaded opening 112 for receiving the redundant fastener 88 is provided in a top side of the tongue 50.

The first and second pins 54, 56 of the second torque transfer structure 43 are preferably secured within the first and second pin receptacles 96, 98 provided at the distal end 72 of the sonde housing 26. For example, the first ands second pins 54, 56 can include threaded ends having external threads that are threaded into corresponding internal threads provided within the first and second pin receptacles 96, 98. The threaded ends of the pins 54, 56 are fixed within the pin receptacles 96, 98 and the opposite ends of the pins 54, 56 comprise free ends that project distally outwardly from the distal end face 94.

Referring to FIGS. 1 and 10-13, the rotary cutting tool 28 of the drilling apparatus 20 comprises a main body including a head portion 120 having a distal side 122 and a proximal side 124. The distal side 122 includes a distal face in which a plurality of cutting teeth pockets 126 are defined. Cutting teeth 128 are mounted within the cutting teeth pockets 126. Friction rings 130 can be used to secure the cutting teeth 128 within the cutting teeth pockets 126. The friction rings 130 (see FIG. 4) preferably allow the cutting teeth 128 to rotate about their central axes during drilling operations. Rear access openings 131 are provided for facilitating tapping the cutting teeth 128 from the cutting teeth pockets 126.

The proximal side 124 of the head portion 120 includes a proximal face 132 in which the first and second sockets 58, 60 of the second torque transfer structure 43 are defined. The first and second sockets 58, 60 have central axes 134, 136 that are parallel to a working axis 138 of the rotary cutting tool 28. The working axis 138 is the axis about which the rotary cutting tool 28 rotates during drilling operations. In the depicted embodiment, working axis 138 is coaxial with the central longitudinal axis 45 of the sonde housing 26 when the rotary cutting tool 28 is mounted to the sonde housing 26. The first and second sockets 58, 60 extend from the proximal face 132 distally into the head portion 120 of the rotary cutting tool 28. The first ands second sockets 58, 60 are sized to respectively receive the free ends of the first and second pins 54, 56 when the rotary cutting tool 28 is coupled to the sonde housing 26.

The main body of the rotary cutting tool 28 also includes a proximal extension 140 that extends proximally from the proximal face 132 of the head portion 120. The proximal extension 140 has a bottom side 142 that faces in a downward direction. The proximal extension 140 defines the axial groove 52 of the first torque transfer structure 41. The axial groove 52 is adapted to receive the tongue 50 when the sonde housing 26 and the rotary cutting tool 28 are coupled together. The groove 52 includes a lip 144 adapted to fit within the undercut region 110 of the tongue 50 when the tongue 50 is inserted within the groove 52. Interference between the lip 144 of the groove 52 and the overhang portion 111 of the tongue 50 prevents the rotary cutting tool 28 from being laterally removed from the sonde housing 26. The bottom side 142 of the proximal extension 140 also defines a second cross-slot 146 that is transverse relative to the working axis 138 of the rotary cutting tool 28. The second cross-slot 146 includes an open bottom side. The second cross-slot 146 is positioned distally with respect to the groove 52 and proximally with respect to the first and second sockets 58, 60.

Figure 11:
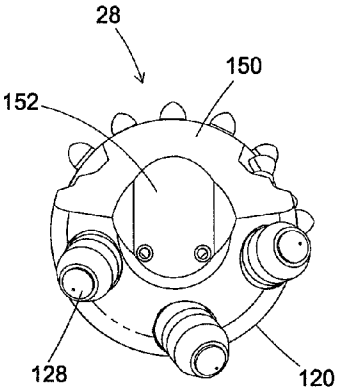
FIG. 11 is a distal end view of the rotary cutting tool of FIG. 9.
Figure 13:
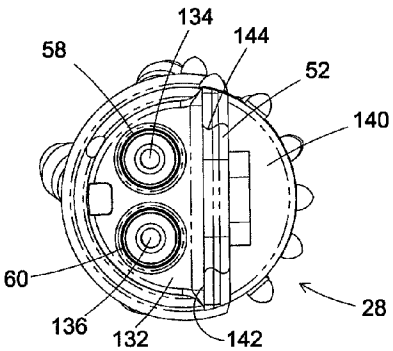
FIG. 13 is a proximal end view of the rotary cutting tool of FIG. 9.
Figure 12:
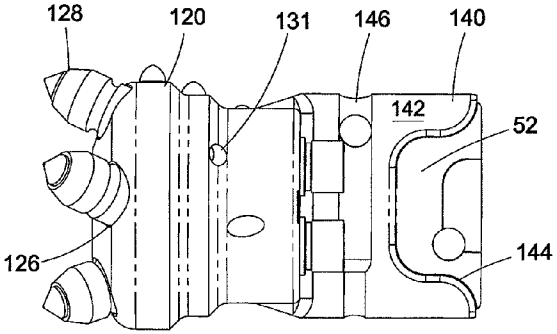
FIG. 12 is a bottom view of the rotary cutting tool of FIG. 9.

The rotary cutting tool 28 further defines an angled face 150 (i.e., a ramp surface) that is angled relative to the working axis 138 and that faces at least partially in the distal direction. The angled face 150 is used to facilitate steering of the filling apparatus 20. As shown at FIGS. 1, 6 and 11, a recess 152 is defined within the angled face 150.

Referring to FIG. 1, a sonde 75 is mounted within the sonde compartment 74. Blocks 77 such as dampening blocks mount the sonde 75 at a fixed position within the sonde housing 26. The sonde 75 is fixed in position relative to the tongue 50 and the pins 54, 56. In this way, the sonde 75 can be used to determine the rotational orientation (roll or clock position) of the sonde housing 26 and the rotary cutting tool 28 about the central axis 45. The rotational orientation of the rotary cutting tool 28 determines the direction in which the angled face 150 of the drill tool 28 faces. By knowing the direction in which the angled face 150 of the cutting tool 28 faces, the operator can manipulate the cutting tool 28 to steer the cutting tool 28 in a desired direction (e.g., a direction opposite from the direction in which the angled face 150 faces). Because the rotary cutting tool 28 is not threaded on the sonde housing 26 and can only be mounted in one rotational orientation due to the configuration of the interface 30, the system is not required to be recalibrated each time a new cutting tool is mounted to the sonde housing 26.

To couple the rotary cutting tool 28 to the sonde housing 26, the sonde housing 26 and the rotary cutting tool 28 are first aligned such that the central longitudinal axis 45 of the sonde housing 26 is coaxial with respect to the working axis 138 of the rotary cutting tool 28. The sonde housing 26 and the rotary cutting tool 28 are then slid together along the coaxially aligned axes, 45, 138 causing the tongue 50 to slide axially within the groove 52 and also causing the first and second pins 54, 56 to slide within the first and second sockets 58, 60. The tongue 50 and groove 52 slide together along the first slide plane P1 and the first and second pins 54, 56 slide within the first and second sockets 58, 60 along with the second slide plane P2. When the rotary cutting tool 28 and the sonde housing 26 have been slid together the full axial slide dimension D1, the first cross-slot 108 of the sonde housing 26 aligns with the second cross-slot 146 of the rotary cutting tool 28. Also, the bottom side 142 of the proximal extension 140 of the rotary cutting tool 28 opposes the top face of the top platform 104 of the sonde housing 26, and the proximal side 124 of the head portion 120 of the rotary cutting tool 28 opposes the distal end face 94 of the sonde housing 26. With the first and second cross-slots 108, 146 aligned with one another, the cross-slots 108, 146 cooperate to define the cross-opening 64 that receives the cross-member 62. By inserting the cross-member 62 within the cross-opening 64, the cross-member 62 prevents the rotary cutting tool 28 from being distally uncoupled from the sonde housing 26. After the cross-member 62 is inserted within the cross-opening 64, a fastener such as a cap screw 155 can be threaded into the fastener receiver 114 located at one end of the first cross-slot 108. In this way, the cross-member 62 is captured within the cross-opening 64 between the cap screw 155 and the reduced diameter portion 112 of the cross-opening 64.

To remove the rotary cutting tool 28 from the sonde housing 26, the fastener 155 is removed from the fastener receiver 114, and the cross-member 62 is punched out of the cross-opening 64. Once the cross-member 62 has been removed, the rotary cutting tool 28 can be slid distally from the sonde housing 26.

The above connection arrangement is advantageous because it allows the rotary cutting tool 28 to be quickly connected and disconnected from the sonde housing 26 in the field. The connection and disconnection process does not require the rotary cutting tool 28 to be threaded onto or off of the sonde housing 26 or otherwise rotated about the axis 45 of the sonde housing 26 during the coupling or uncoupling process. Therefore, bulky tongs or other similar large tools are not needed to couple or uncouple the rotary cutting tool 28 from the sonde housing 26. Moreover, because the axial slide dimension D1 is relatively short, only a relatively small amount of space is needed to connect and disconnect the rotary cutting tool 28 from the sonde housing 26. Therefore, to access the rotary cutting tool 28 underground to exchange the rotary cutting tool 28 with another tool, only a relatively small pit need be excavated.

Figure 14:
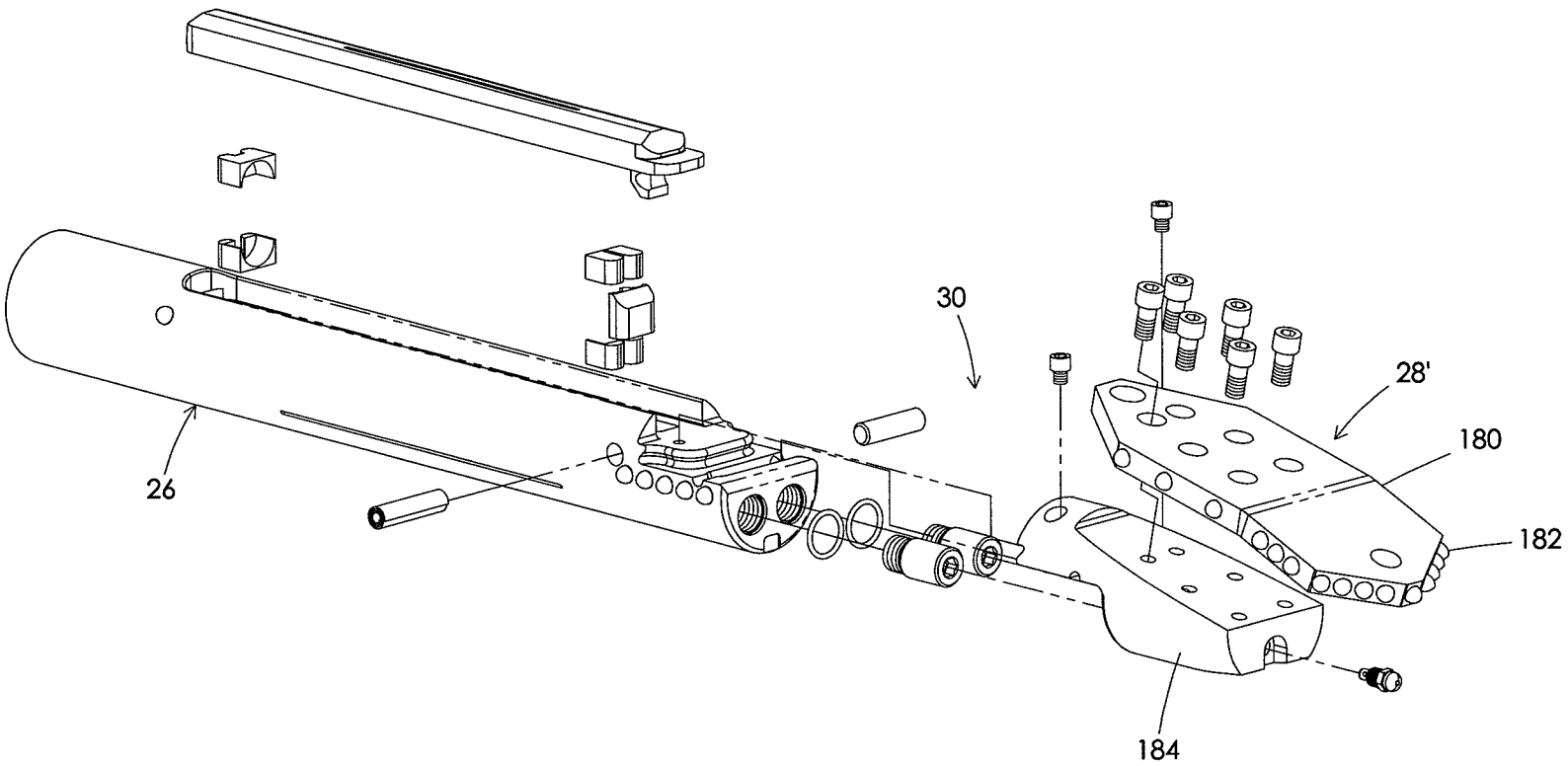
FIG. 14 illustrates another rotary cutting tool that can be interchanged with the rotary cutting tool of FIG. 1.
Figure 15:
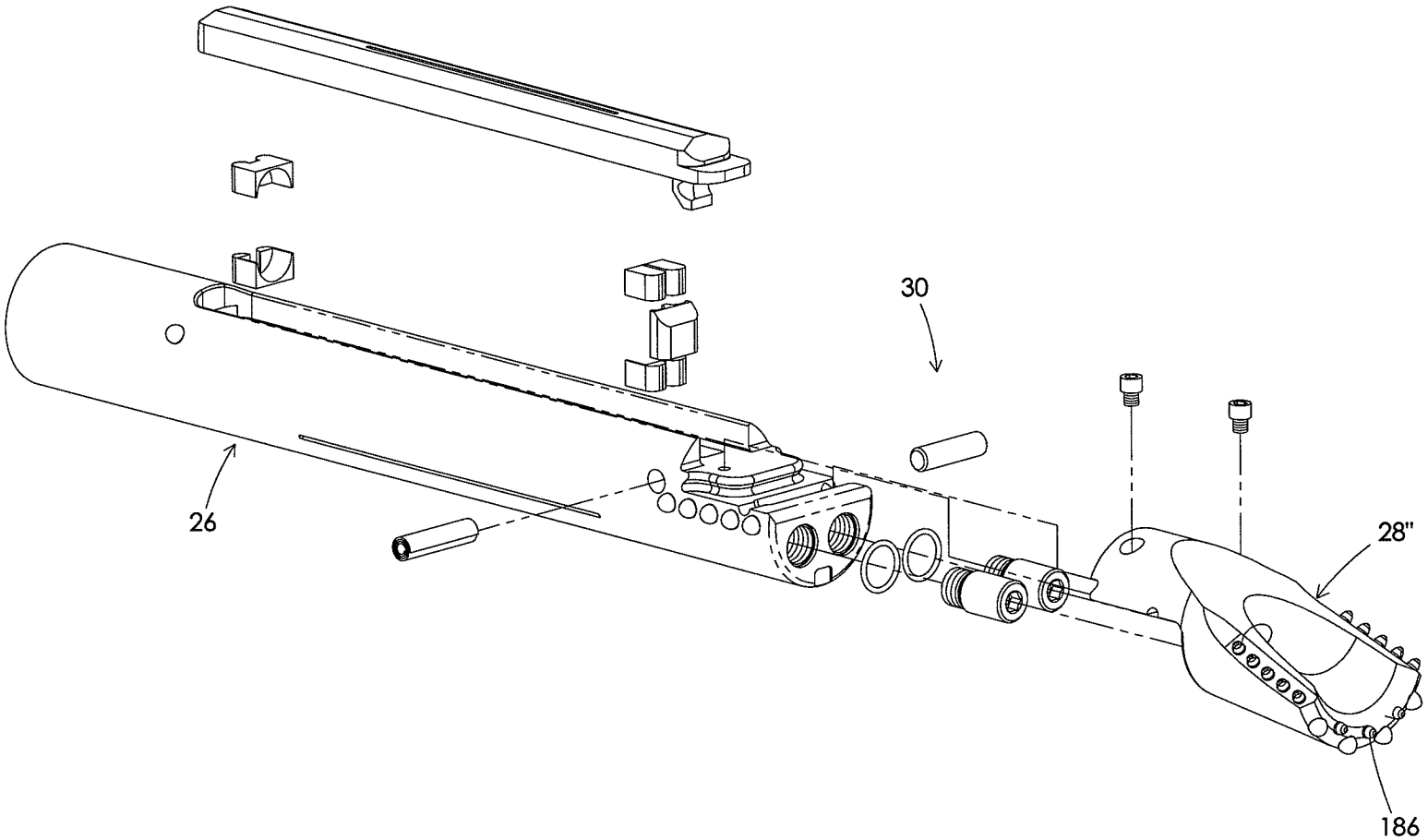
FIG. 15 illustrates still another rotary cutting tool that can be interchanged with the rotary cutting tool of FIG. 1.

It will be appreciated that other types of tools can also be mounted to the distal end 72 of the sonde housing 26 using the same coupling arrangement used to secure the rotary cutting tool 28 to the distal end 72 of the sonde housing 26. For example, FIGS. 14 and 15 show alternative rotary cutting tools 28', 28" that can be coupled to the sonde housing 26 using the same type of interface 30 described with respect to the rotary cutting tool 26. The rotary cutting tool 28' includes a plate cutter 180 having carbide buttons 182 connected thereto. The plate cutter 180 is fastened to a body 184 adapted to interface with the sonde housing 26. The rotary cutting tool 28" is similar to the cutting tool 28 but has different sized teeth 186, a different tooth pattern and a main body with a larger front concavity.

Figure 16:
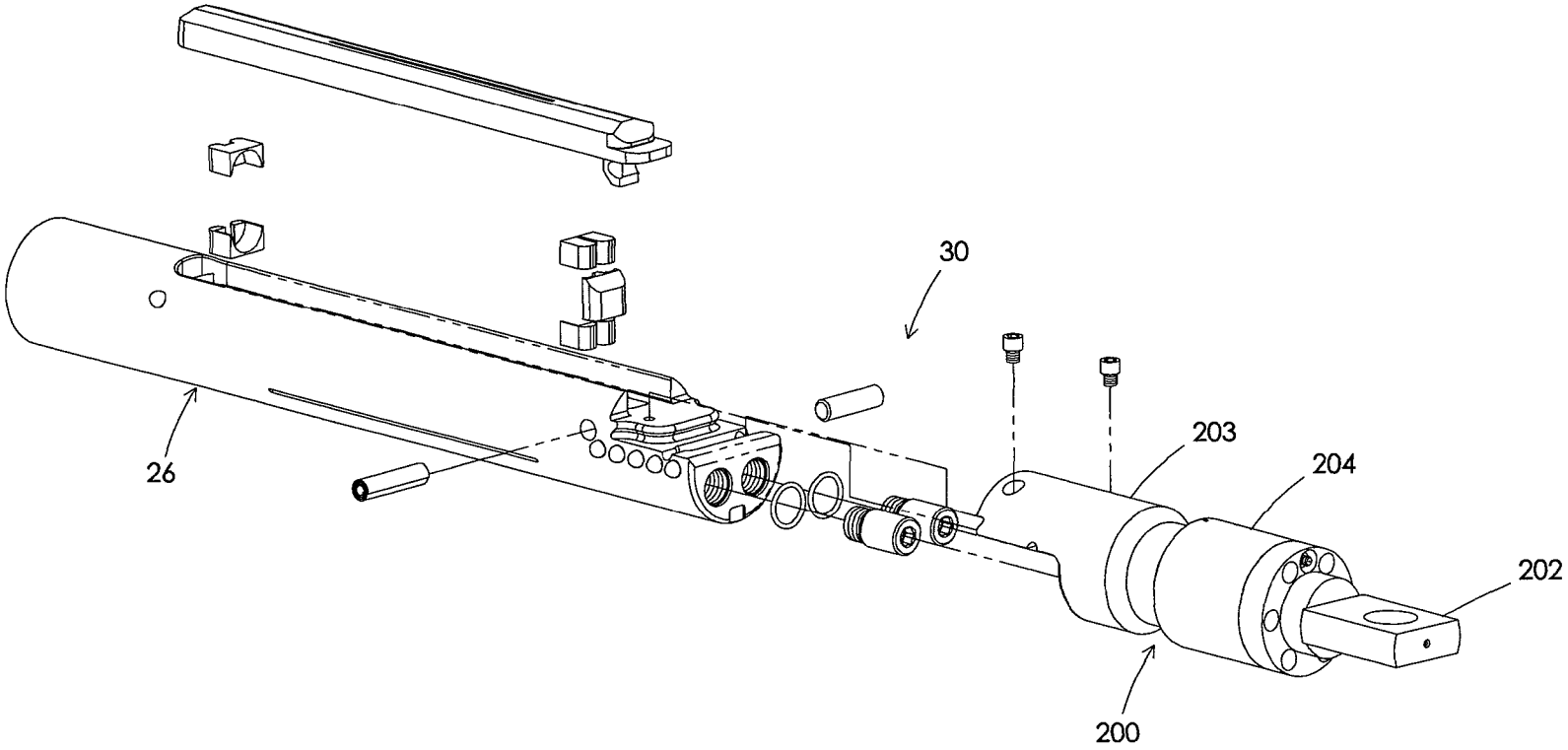
FIG. 16 illustrates a product pulling eye assembly adapted to be interchanged with the rotary cutting tool of FIG. 1.
Figure 17:
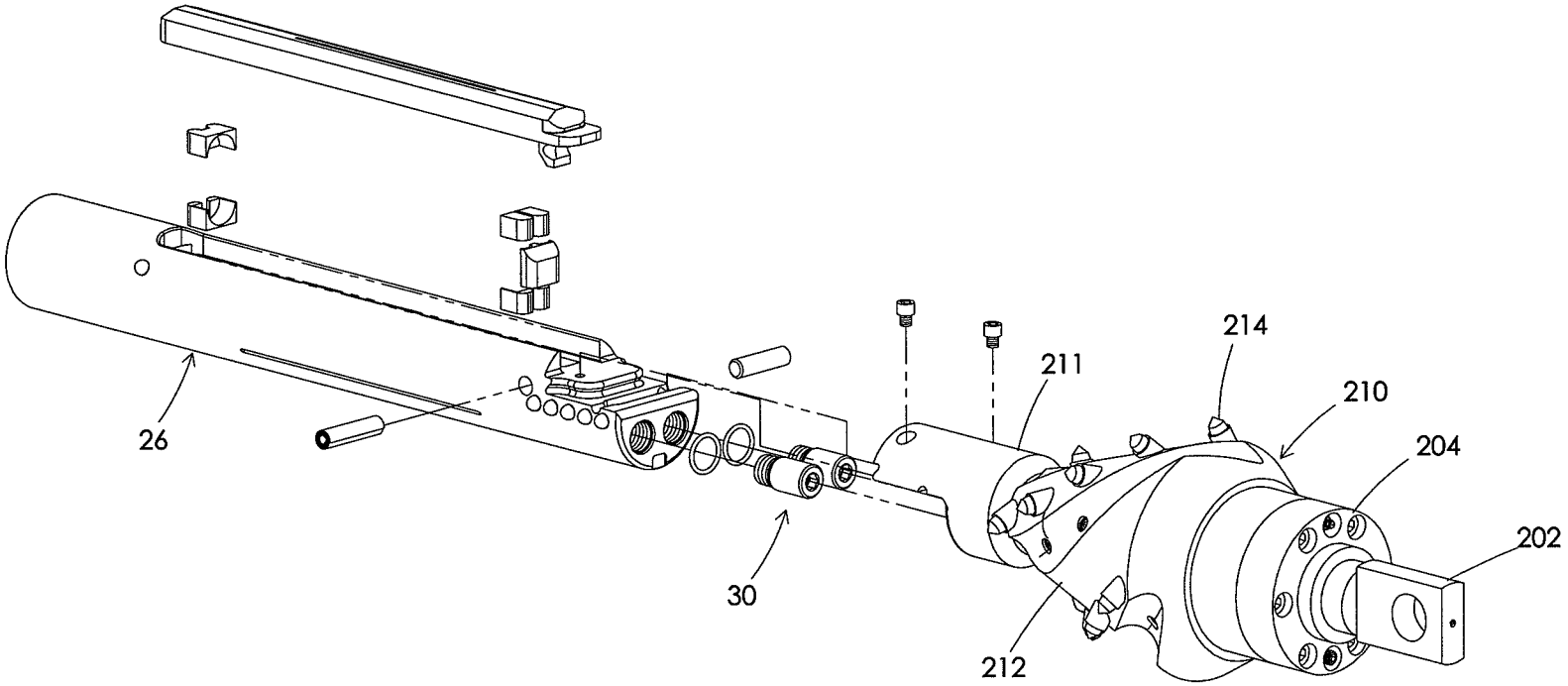
FIG. 17 illustrates a combined back reamer and pulling eye assembly that is adapted to be interchanged with the rotary cutting tool of FIG. 1.
Figure 18:
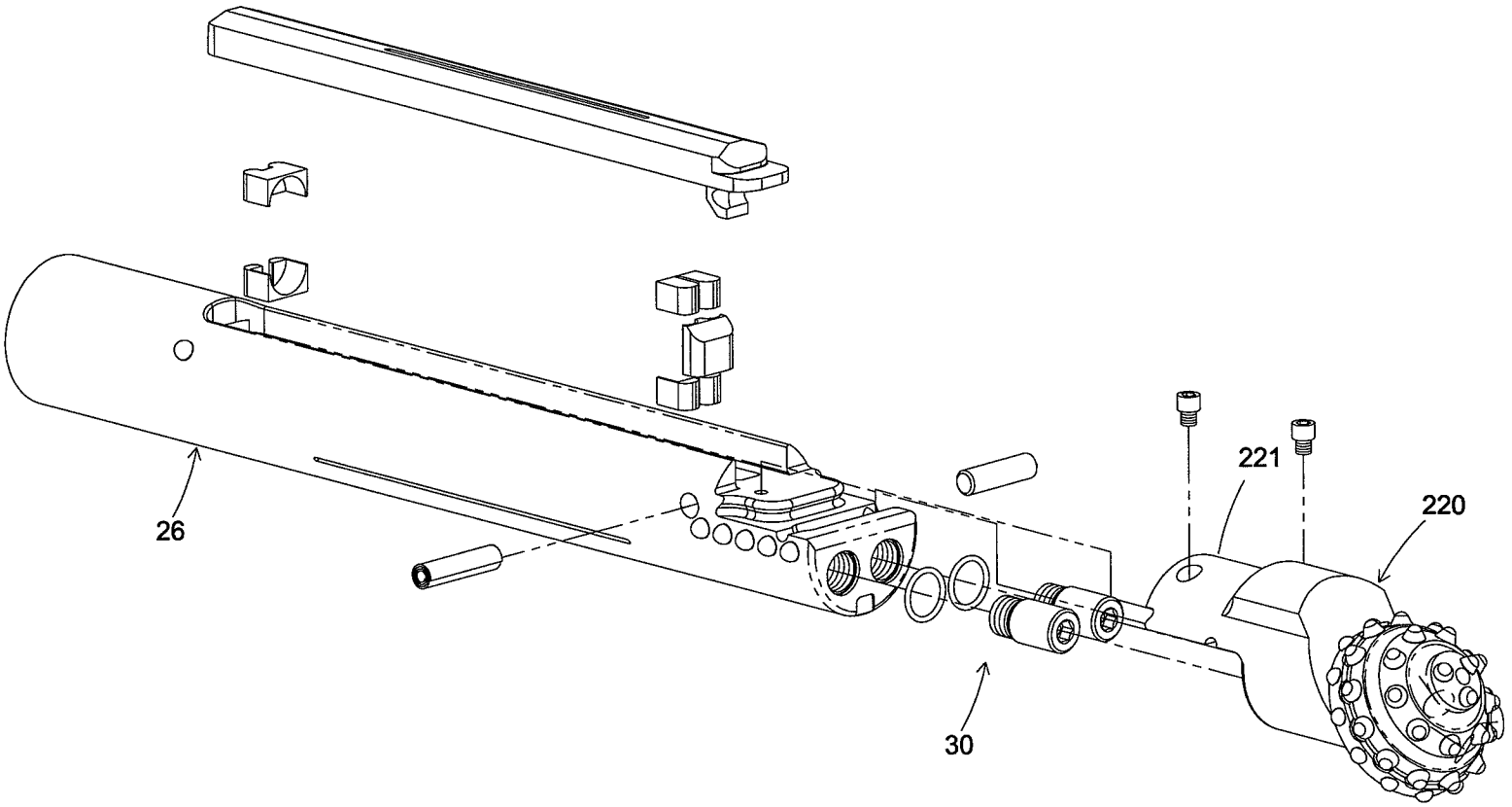
FIG. 18 illustrates a back reamer assembly that is adapted to be interchanged with the rotary cutting tool of FIG. 1.
Figure 22:
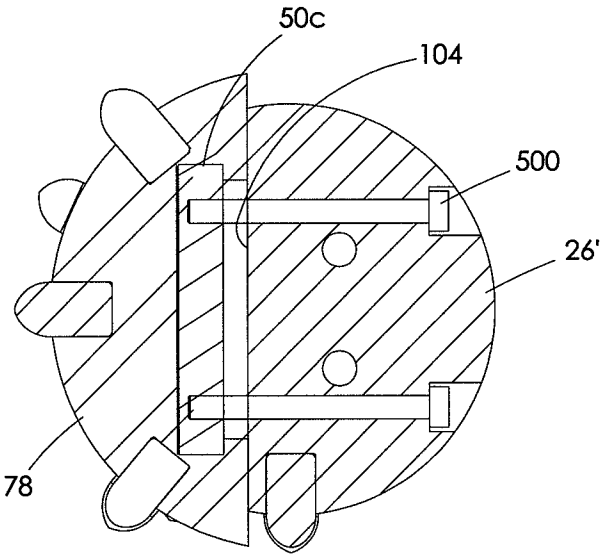
FIG. 22 shows still another tongue and groove configuration for connecting a rotary cutting tool to a sonde housing.
Figure 21:
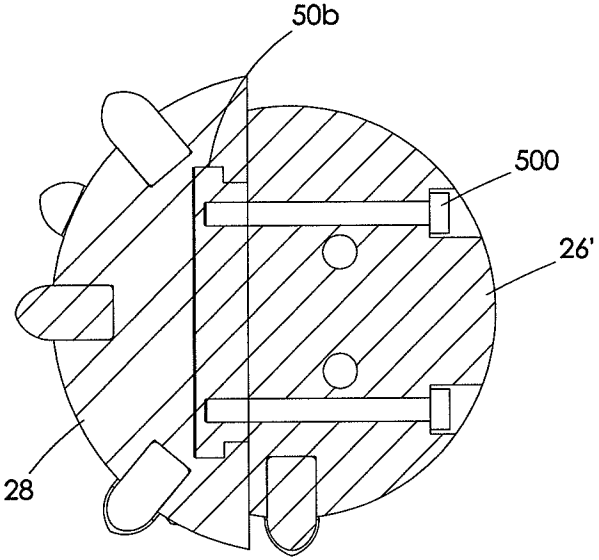
FIG. 21 is a cross-sectional view showing another tongue and groove configuration for connecting a rotary cutting tool to a sonde housing.

FIG. 16 shows a rotatable pulling eye assembly 200 that can be coupled to the sonde housing 26 using the same type of interface 30 described with respect to the rotary cutting tool 26. The pulling eye assembly 200 includes a pulling eye 202 and a bearing 204 for allowing the pulling eye 202 to spin relative to the sonde housing 26 about the central longitudinal axis 45 of the sonde housing. The bearing 204 and the pulling eye 202 are coupled to a body 203 adapted to interface with the sonde housing 26. FIG. 17 shows a combined back reamer and rotary pulling eye assembly 210 that can be coupled to the sonde housing 26 using the same interface 30 described with respect to the rotary cutting tool 28. The back reamer assembly 210 includes a generally conical member 212 on which a plurality of proximally facing cutting teeth 214 are mounted. The assembly 210 also includes a pulling eye 202 and a bearing 204 for allowing the conical member 212 and the sonde housing 26 to rotate relative to the pulling eye 202 so that the product being pulled into the bore with the pulling eye is not rotated/twisted during installation. The assembly 210 also includes a body 211 adapted to interface with the sonde housing 26. FIG. 18 shows another back reamer assembly 220 that can be mounted to the sonde housing 26 using a body 221 which provides the same coupling interface described with respect to the rotary cutting tool 28.

As described above, the configuration of the coupling interface 30 allows tools such as the pulling eye assembly 200, the combined back reamer and pulling eye assembly 210 and the back reaming assembly 220 to be readily interchanged with one of the rotary cutting tools 28, 28' or 28" within a relatively small pit. The drilling apparatus 20 can be used to drill a bore to a desired underground location. At the desired location, a pit can be excavated to access the rotary cutting tool 28, 28' or 28" at the underground location. The rotary cutting tool 28 can then be removed from the sonde housing 26 and replaced with another tool. For example, the rotary cutting tool 28, 28' or 28" can be replaced with the pulling eye assembly 200. By mounting the pulling eye assembly 200 on the sonde housing 26, the drill string 24 can be used to pull back product (e.g., pipe) into previously drilled the bore. For example, the product can be attached to the pulling eye, and then the drill string 24 can be withdrawn from the bore thereby pulling the product into the bore. If the product is larger than the bore, the combined reamer and pulling eye 210 can be coupled to the sonde housing 26 and used to enlarge the bore via rotation of the back reamer 214 as the product is pulled into the bore. If it is desired to merely enlarge the bore without simultaneously pulling product back into the bore, a back reamer such as the back reamer 220 of FIG. 18 can be used to replace the rotary cutting tool 28, 28', 28". By pulling back the drill string with the back reamer 220 attached, and by concurrently rotating the drill string 24, the back reamer 220 effectively enlarges the size of the bore.

For most drilling applications, it is desirable to provide drilling fluid to the rotary cutting tool 28 during drilling. Typically, drilling fluid can be pumped down the drill string 24 into the rotary cutting tool and discharged through ports. As shown at FIGS. 6 and 7, the sonde housing 26 is adapted to receive drilling fluid through the socket 71 at the proximal end 70 of the sonde housing 26. From the socket 71, the drilling fluid can travel through two separate, parallel passages 300 that extend from the socket 71 to the first and second pin receptacles 96, 98. From the first and second pin receptacles 96, 98, the fluid flows through the first and second pins 54, 56 to distal passages 302 extending through the head portion 120 of the rotary cutting tool 28. The distal passages 302 extend from their respective pins 54, 56 to discharge ports 304 located at the recess 152 in the angled face 150. Advantageously, the arrangement utilizes two separate passages/flow lines that extend separately from the socket 71 at the proximate end of the sonde housing 26 to the discharge ports 304. By having two separate fluid lines extending substantially the entire length of the apparatus 20, one is always available in the event the other becomes plugged. Moreover, the generally straight paths of the fluid lines reduces the likelihood of plugging.

Figure 3:
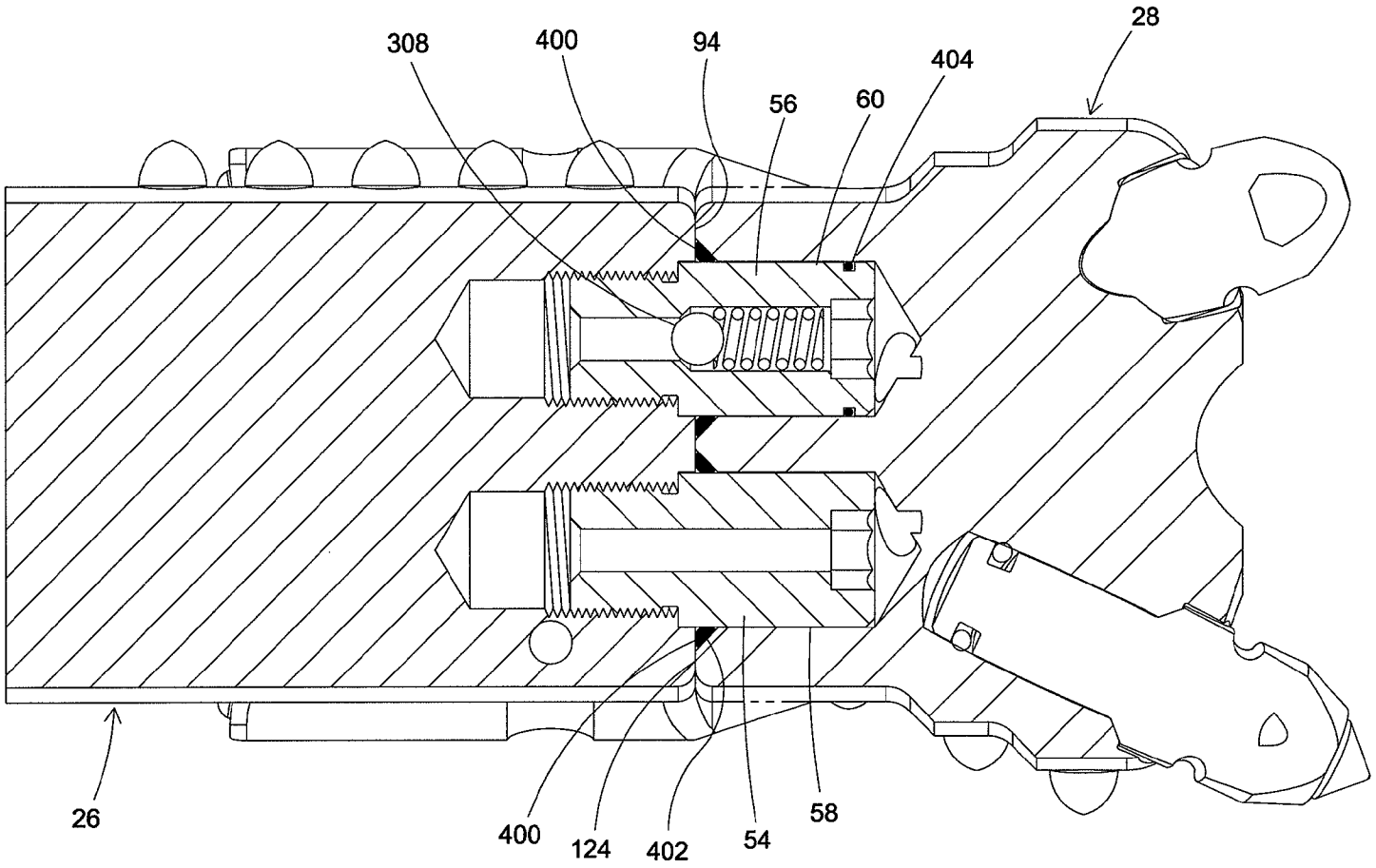
FIG. 3 is a cross-sectional view taken along section line 3-3 of FIG. 2.
Figure 4:
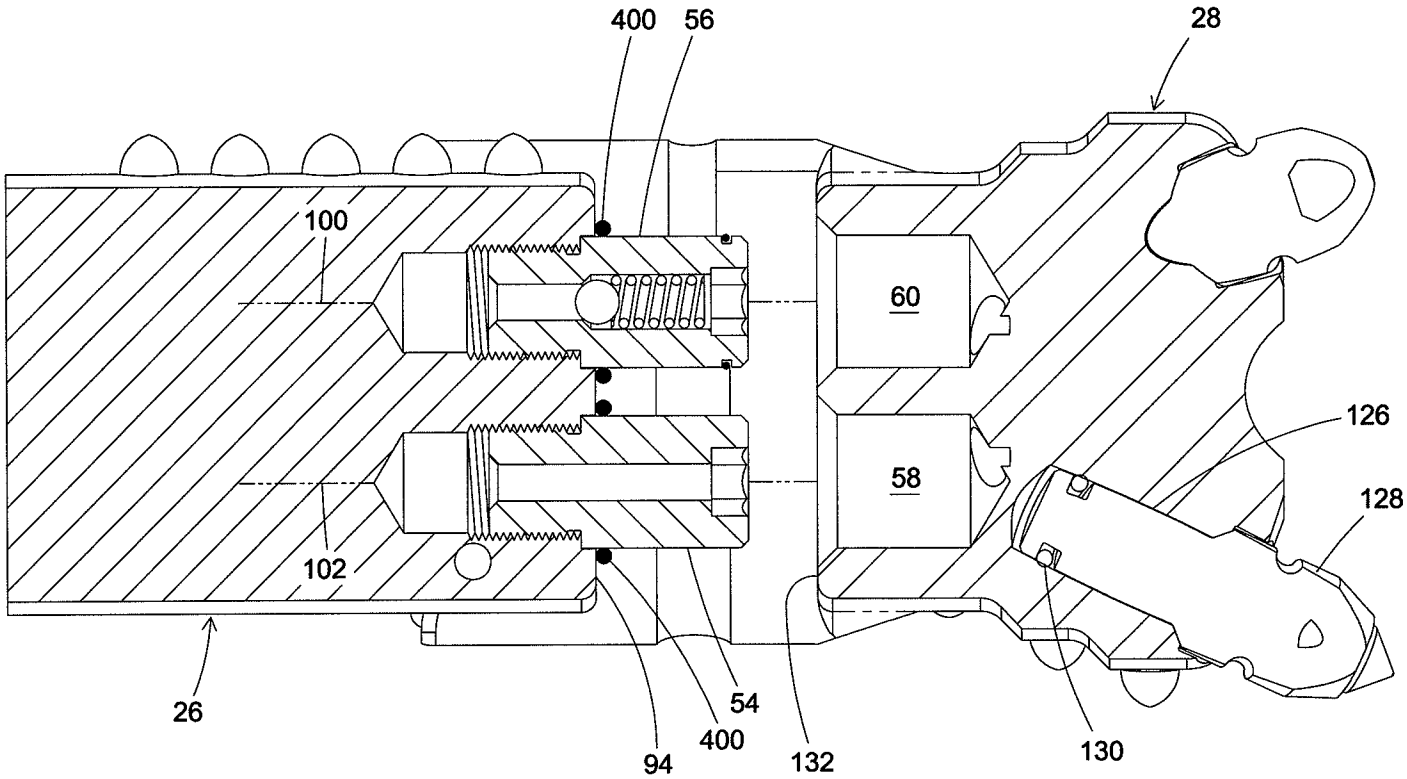
FIG. 4 is the cross-sectional view of FIG. 3 with the rotary cutting tool disengaged from the sonde housing.
Figure 19:
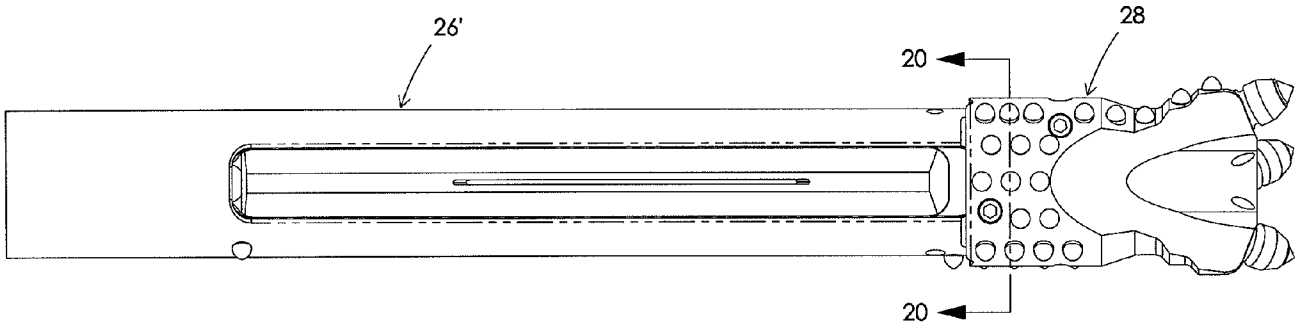
FIG. 19 is a top view of an alternative sonde housing and rotary cutting tool in accordance with the principles of the present disclosure.
Figure 20:
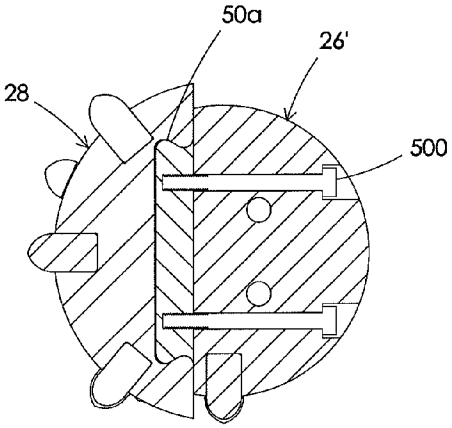
FIG. 20 is a cross-sectional view taken along section line 20-20 of FIG. 19 showing a tongue and groove configuration for connecting the rotary cutting tool to the sonde housing.
Figure 5:
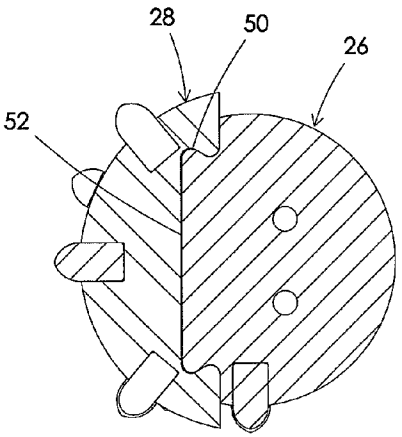
FIG. 5 is a cross-sectional view taken along section line 5-5 of FIG. 2.
Figure 23:
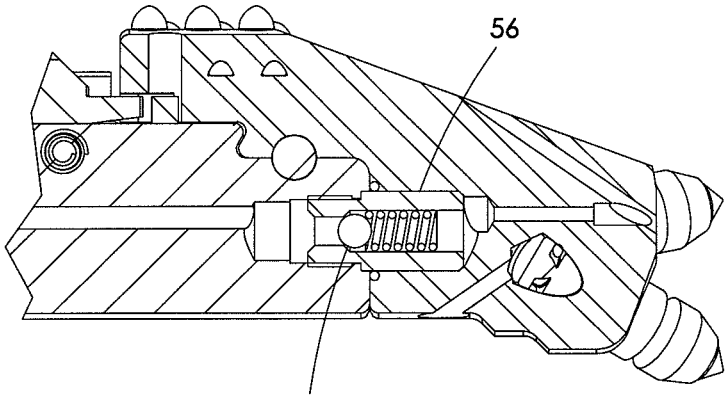
FIG. 23 is a cross-sectional view showing a check valve mounted in a pin of the sonde housing and rotary cutting tool of FIG. 1.
Figure 24:
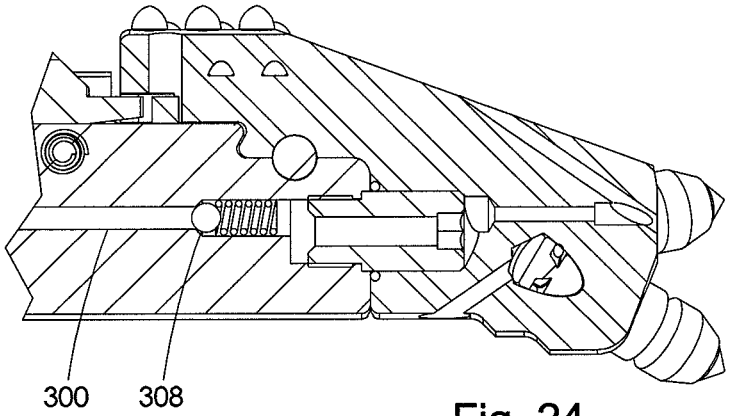
FIG. 24 is a cross-sectional view showing a check valve mounted in the sonde housing of FIG. 1.
Figure 25:
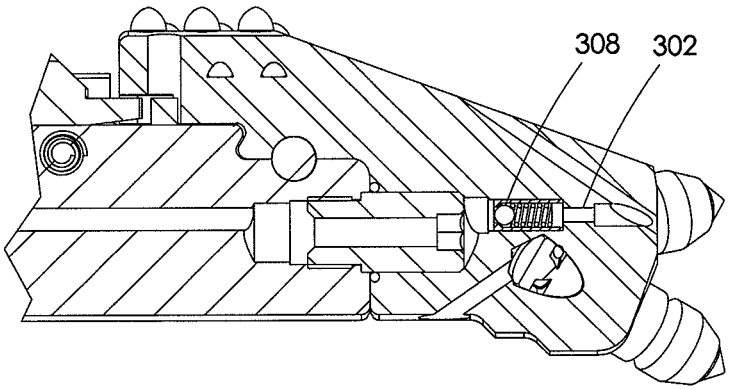
FIG. 25 is a cross-sectional view showing a check valve mounted in the rotary cutting tool of FIG. 1

Referring to FIG. 3, annular seals 400 are provided around the pins 54, 56 for preventing drilling fluid from leaking from the drilling apparatus 20 at the interface between the sonde housing 26 and the rotary cutting tool 28. The seals 400 can be compressed between the distal end face 94, the outer circumferential surface of the pins 54, 56, and ramp surfaces 402 provided adjacent the proximal side 124 of the head portion 120. Optionally, additional seals 404 (only shown on one of the pins) can be provided around the pins 54, 56 adjacent the wide ends of the sockets 58, 60. Such seals can be used to prevent contamination of the outer surfaces of the pins 54, 56. Moreover, valve structures can be provided in the pins 54, 56 for restricting (e.g., limiting, blocking, stopping, or preventing) flow through the flow lines defined by passages 300, 302 in a proximal direction while allowing flow in a distal direction. For example, FIGS. 3, 4 and 23 show a check valve 308 in pin 56. In other embodiments, the valving need not be in the pins and can be located at alternative locations along the fluid lines/passages. For example, FIG. 24 shows a check valve 308 in one of the passages 300 defined by the sonde housing 26 and FIG. 25 shows a check valve 308 in one of the distal end passages 302 defined by the rotary cutting tool 28.

In certain embodiments, is may be desirable to detachably attach the tongue 50 to the sonde housing 26 so that it can be removed and replaced when the tongue becomes worn. FIGS. 20-23 show various tongues 50*a*, 50*b* and 50*c* attached to a sonde housing 26' by removable fasteners 500. Tongue 50*c* is spaced from the platform 104 and can be used to clamp the rotary drilling tool 28 to the sonde housing 26 when the fasteners 500 are tightened.

Figure 26:
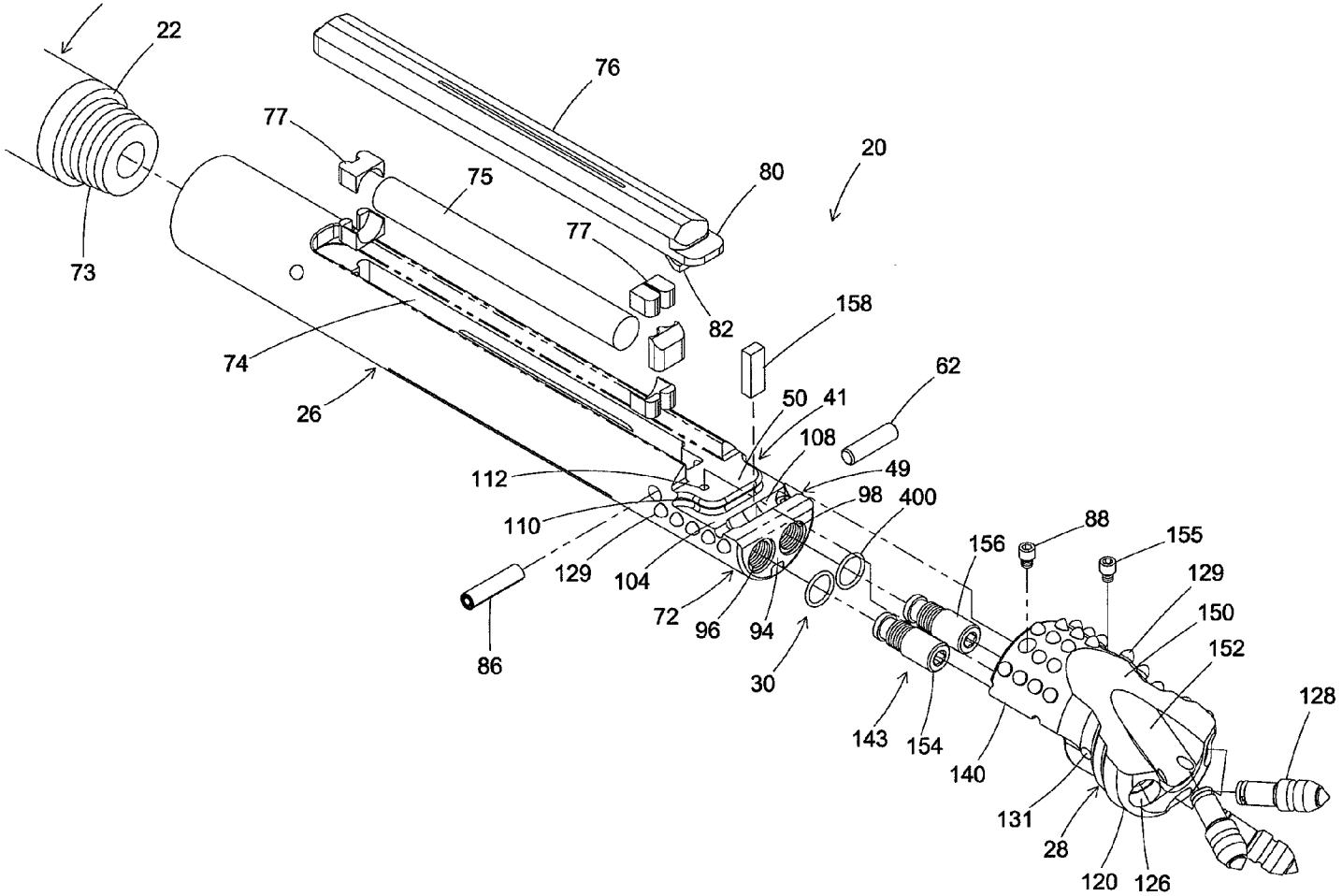
FIG. 26 is another exploded, perspective view of a sonde housing and rotary cutting tool in accordance with the principles of the present disclosure.
Figure 27:
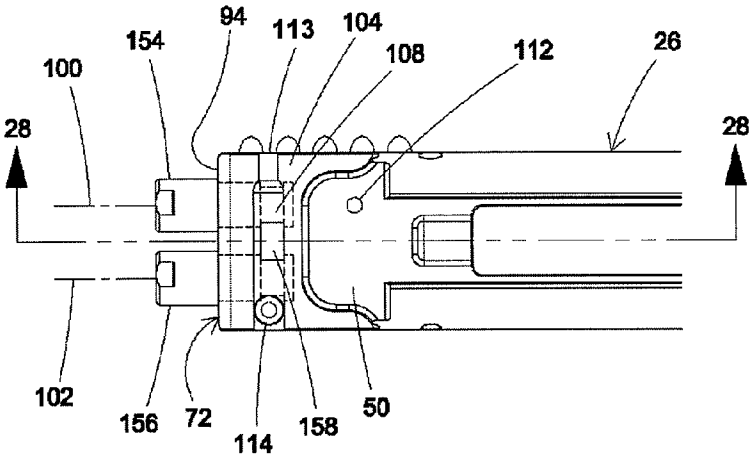
FIG. 27 shows a distal end of the sonde housing of FIG. 26.
Figure 28:
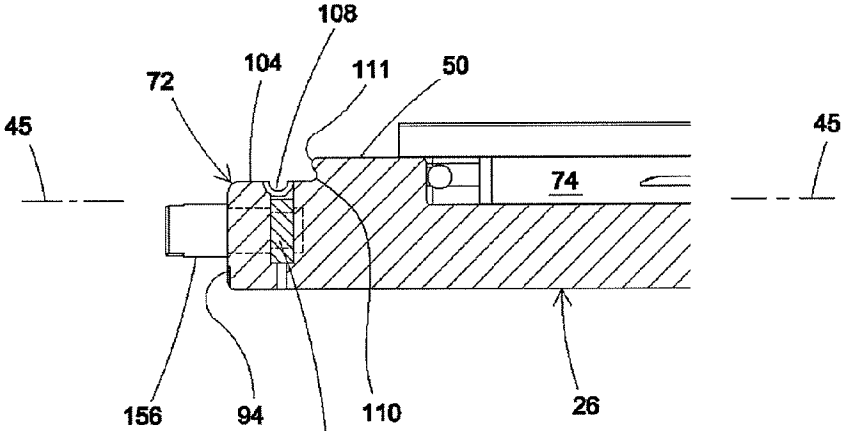
FIG. 28 is a cross-sectional view taken along section line 28-28 of FIG. 27.
Figure 29:
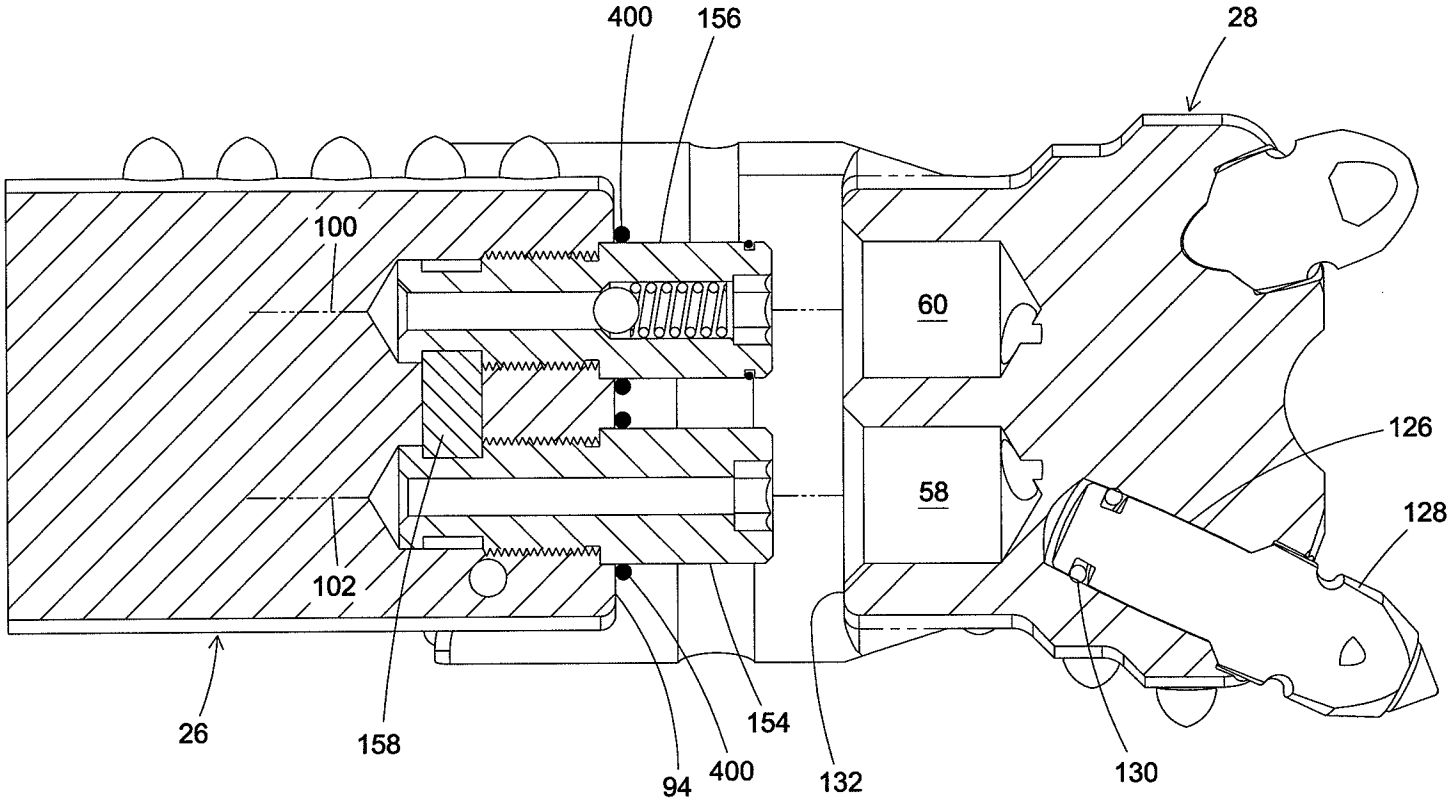
FIG. 29 is a cross-sectional view of the distal end of the sonde housing of FIG. 26 with the rotary cutting tool disengaged from the sonde housing.

FIG. 26 shows a drilling apparatus 20 which is configured in the same manner as the drilling apparatus of FIG. 1. In some embodiments, however, the pins are provided with a redundant locking device. For example, FIGS. 26-29 show pins 154 and 156 that are different from the pins 54, 56 shown in FIG. 1. The pins 154, 156 comprise first ends that project distally outwardly from the distal end face 94 of sonde housing 26. The pins 154, 156 comprise second ends that are inserted in the pin receptacles 96, 98 of the sonde housing 26. The second ends of the pins 154, 156 are secured in the pin receptacles 96, 98 with a redundant locking mechanism. For example, the pins 154, 156 are provided with external threads that are threaded into corresponding internal threads within the pin receptacles 96, 98. The second ends of the pins 154, 156 also include notches for receiving a key 158. The key 158 fits into an aperture in the sonde housing 26 and holds the pins 154, 156 from backing-out in case the threaded connections loosen.

For ease of explanation, various components have been described in directional terms such as "top", "bottom", "upwardly", and "downwardly" so as to provide relative frames of reference for describing the parts. These terms do not suggest that the disclosed apparatus is required to be used in a particular orientation. Quite to the contrary, during drilling operations, the drilling apparatus is rotated about a drill axis such that the directions in which the various parts of the drilling apparatus face are constantly changing. As used herein, "receptacles", "sockets" and "receivers" can be referred to as openings. In the depicted embodiment, the rotary cutting tool 28 is shown connected to the sonde housing 26. In alternative embodiments, the rotary cutting tool 28 can be connected to other types of drive members such as rods, stems, subs or other structures that do not contain sondes. In certain embodiments, carbide buttons 129 are provided at various locations on the drilling apparatus 20 to limit wear and enhance drilling productivity.

The invention claimed is:

1. A drilling apparatus comprising:

a sonde housing that is elongated along a central longitudinal axis, the sonde housing having a length that extends along the central longitudinal axis from a proximal end of the sonde housing to a distal end of the sonde housing, the proximal end of the sonde housing being adapted for connection to a drill string and the distal end of the sonde housing including a distal end face, the sonde housing defining first and second pin openings that extend from the distal end face proximally into the sonde housing, the first and second pin openings of the sonde housing having central axes that extend along the central longitudinal axis of the sonde housing, the sonde housing also including a top platform positioned adjacent to the distal end of the sonde housing, the top platform facing in an upward direction, the sonde housing defining a first cross-slot at the top platform, the first cross-slot being transverse relative to the central longitudinal axis of the sonde housing and having an open top side, the sonde housing also including a tongue positioned on the top platform;

a rotary cutting tool that mounts to the distal end of the sonde housing, the rotary cutting tool including a head portion having a distal side and a proximal side, the distal side including a distal face in which a plurality of cutting teeth pockets are defined, the proximal side including a proximal face that opposes the distal end face of the sonde housing, the rotary cutting tool defining first and second pin openings that extend distally from the proximal face and respectively co-axially align with the first and second pin openings of the sonde housing, the rotary cutting tool also including a proximal extension that extends proximally from the proximal face of the head portion, the proximal extension having a bottom side that opposes the top platform of the sonde housing, the proximal extension defining a groove that receives the tongue of the sonde housing in an insertion direction that extends along the central longitudinal axis of the sonde housing, the bottom side of the proximal extension also including a second cross-slot that is transverse relative to the central longitudinal axis of the sonde housing, the second cross-slot including an open bottom side and being positioned to oppose the first cross-slot of the sonde housing;

first and second pins having first ends respectively received in the first and second pin openings of the sonde housing and second ends respectively received in the first and second pin openings of the rotary cutting tool;

cutting teeth mounted within the cutting teeth pockets of the rotary cutting tool; and a cross pin mounted within the first and second cross-slots for limiting relative movement between the sonde housing and the rotary cutting tool along the central longitudinal axis of the sonde housing.

2. The drilling apparatus of claim 1, wherein the tongue is removably attached to the top platform of the sonde housing.

3. The drilling apparatus of claim 1, further comprising a removable fastener for attaching the tongue to the top platform of the sonde housing.

4. The drilling apparatus of claim 1, wherein the rotary cutting tool has a central working axis that is co-axial with the central longitudinal axis of the sonde housing, and wherein the head portion of the rotary cutting tool includes a ramp surface that faces at least partially in a distal direction and that is angled relative to the central working axis.

5. The drilling apparatus of claim 1, wherein the proximal extension of the rotary cutting tool overlaps at least a portion of a cover member of the sonde housing.

6. The drilling apparatus of claim 1, wherein separate drilling fluid delivery passages run separately throughout substantially an entire length of the drilling apparatus.

7. The drilling apparatus of claim 6, wherein the separate drilling fluid delivery passages pass through the first and second pins.

8. The drilling apparatus of claim 7, wherein one-way valve structures are positioned within at least one of the first and second pins.

9. The drilling apparatus of claim 7, wherein axially spaced-apart seals are provided about at least one of the first and second pins.

10. The drilling apparatus of claim 1, wherein the first and second pins are secured to the sonde housing with a redundant locking mechanism.

11. The drilling apparatus of claim 10, wherein the first and second pins include external threads that are threaded into corresponding internal threads of the first and second pin openings of the sonde housing, and wherein the first and second pins include notches configured to receive a locking key for locking the first and second pins to the sonde housing.

12. A driver for a drill string comprising:

a member that is elongated along a central longitudinal axis, the member having a length that extends along the central longitudinal axis from a proximal end to a distal end of the member, the proximal end of the member being adapted for connection to the drill string and the distal end of the member including a distal end face, the member defining first and second pin openings that extend from the distal end face proximally into the member, the first and second pin openings having central axes that extend along the central longitudinal axis of the member, the member also including a top platform positioned adjacent to the distal end of the member, the top platform facing in an upward direction, the member defining a first cross-slot at the top platform, the first cross-slot being transverse relative to the central longitudinal axis of the member and having an open top side, the member also including a tongue positioned on the top platform.

13. A tool adapted for use with drilling equipment, the tool comprising:

a body having a proximal side including a proximal face defining a socket arrangement that extends distally from the proximal face through the body along an axis of the tool; and a proximal extension that extends proximally from the proximal face of the body, the proximal extension having a bottom side defining a groove that extends along the axis of the tool, the bottom side of the proximal extension also including a tool cross-slot that is transverse relative to the axis of the tool, the tool cross-slot including an open bottom side, and the proximal face of the body extending downwardly from the bottom side of the proximal extension.

14. The tool of claim 13, further comprising a plate-style cutter attached to the body, a back reamer coupled to the body, or a pulling eye coupled to the body.

15. The tool of claim 13, wherein the axis of the tool is a working axis of the tool about which the tool rotates during drilling, and wherein the socket arrangement is offset from the working axis.

16. The tool of claim 13, wherein the tool comprises a rotary cutting tool and the body includes a head portion having a distal cutting side, and wherein the axis comprises a working axis about which the rotary cutting tool is rotated during drilling.

17. The tool of claim 16, wherein the head portion defines cutting teeth pockets, and wherein cutting teeth are mounted within the cutting teeth pockets of the rotary cutting tool.

18. The tool of claim 17, wherein the head portion of the rotary cutting tool includes a ramp surface that faces at least partially in a distal direction and that is angled relative to the working axis of the rotary cutting tool.

19. The tool of claim 13, wherein the socket arrangement includes first and second sockets for receiving first and second pins.

20. A drilling apparatus that includes the tool of claim 13, further comprising a sonde housing that couples together with the tool and that is elongated along a central longitudinal axis, the sonde housing having a length that extends along the central longitudinal axis from a proximal end of the sonde housing to a distal end of the sonde housing, the proximal end of the sonde housing being adapted for connection to a drill string and the distal end of the sonde housing including a distal end face, the sonde housing including a pin arrangement that projects distally from the distal end face and that is received within the socket arrangement of the tool when the tool and sonde housing are coupled together, the sonde housing also including a top platform positioned adjacent to the distal end of the sonde housing, the top platform facing in an upward direction, the sonde housing defining a sonde cross-slot at the top platform, the sonde cross-slot being transverse relative to the central longitudinal axis of the sonde housing and having an open top side, the sonde housing also including a tongue positioned on the top platform, the bottom side of the proximal extension of the tool opposing the top platform of the sonde housing when the sonde housing and the tool are coupled together, the groove of the proximal extension of the tool receiving the tongue of the sonde housing in an insertion direction that extends along the central longitudinal axis of the sonde housing, the open bottom side of the tool cross-slot being positioned to oppose the open top side of the sonde cross-slot when the tool and the sonde housing are coupled together, the drilling apparatus further including a cross pin that mounts within the tool and sonde cross-slots for limiting relative movement between the sonde housing and the tool along the central longitudinal axis of the sonde housing.

21. The drilling apparatus of claim 20, wherein the proximal extension of the tool overlaps at least a portion of a cover member of the sonde housing.

22. The drilling apparatus of claim 20, wherein separate drilling fluid delivery passages run separately through the pin arrangement.

23. A drilling apparatus that includes the tool of claim 13, further comprising a member that couples together with the tool and that is elongated along a central longitudinal axis, the member having a length that extends along the central longitudinal axis from a proximal end to a distal end of the member, the proximal end of the member being adapted for connection to a drill string and the distal end of the member including a distal end face, the member including a pin arrangement that projects distally from the distal end face and that is received within the socket arrangement of the tool when the tool and member are coupled together, the member also including a top platform positioned adjacent to the distal end of the member, the top platform facing in an upward direction, the member defining a member cross-slot at the top platform, the member cross-slot being transverse relative to the central longitudinal axis of the member and having an open top side, the member also including a tongue positioned on the top platform, the bottom side of the proximal extension of the tool opposing the top platform of the member when the member and the tool are coupled together, the groove of the proximal extension of the tool receiving the tongue of the member in an insertion direction that extends along the central longitudinal axis of the member, the open bottom side of the tool cross-slot being positioned to oppose the open top side of the member cross-slot when the tool and the member are coupled together, the drilling apparatus further including a cross pin that mounts within the tool and member cross-slots for limiting relative movement between the member and the tool along the central longitudinal axis of the member.

24. The drilling apparatus of claim 23, wherein the tongue is removably attached to the top platform of the member.

25. The drilling apparatus of claim 24, further comprising a removable fastener for attaching the tongue to the top platform of the member.

* * * * *